United States Patent [19]

Mayor et al.

[11] 3,991,564

[45] Nov. 16, 1976

[54] DUAL PRESSURE LEVEL OIL SUPPLY SYSTEM

[75] Inventors: Harry A. Mayor; George W. Minkkinen, both of Fitchburg, Mass.

[73] Assignee: General Electric Company, Schenectady, N.Y.

[22] Filed: Feb. 25, 1976

[21] Appl. No.: 661,169

[52] U.S. Cl. ..... 60/325; 60/405; 60/456; 60/698; 60/DIG. 3; 60/DIG. 5

[51] Int. Cl.[2] ..... F16D 31/06

[58] Field of Search ..... 60/337, 339, 396, 405, 60/456, 698, 714, DIG. 3, DIG. 5; 415/143, 175, 366

[56] References Cited

UNITED STATES PATENTS

| | | | |
|---|---|---|---|
| 1,613,753 | 1/1927 | Hodgkinson | 60/396 |
| 2,252,456 | 8/1941 | Buehman | 60/714 X |
| 3,034,288 | 5/1962 | French | 60/396 |

*Primary Examiner*—Edgar W. Geoghegan
*Attorney, Agent, or Firm*—James W. Mitchell; John F. Ahern

[57] ABSTRACT

A hydraulic fluid supply system includes a single motor driven pump which supplies a dual pressure level output for providing both a high pressure oil output and a low pressure oil output. In combination with a turbomachine, the dual pressure level output of the oil pump obviates the requirement of pressure reducing valves in the low pressure supply lines and losses associated therewith. Moreover, since only a portion of the entire oil requirement is raised to the higher pressure level, the pump motor horsepower requirements are reduced to save energy and thereby improve overall system efficiency. A further improvement is a system of pressure differential valves whereby under certain conditions, high pressure oil flow is conserved even though the low pressure oil flow momentarily drops below a preset value.

8 Claims, 1 Drawing Figure

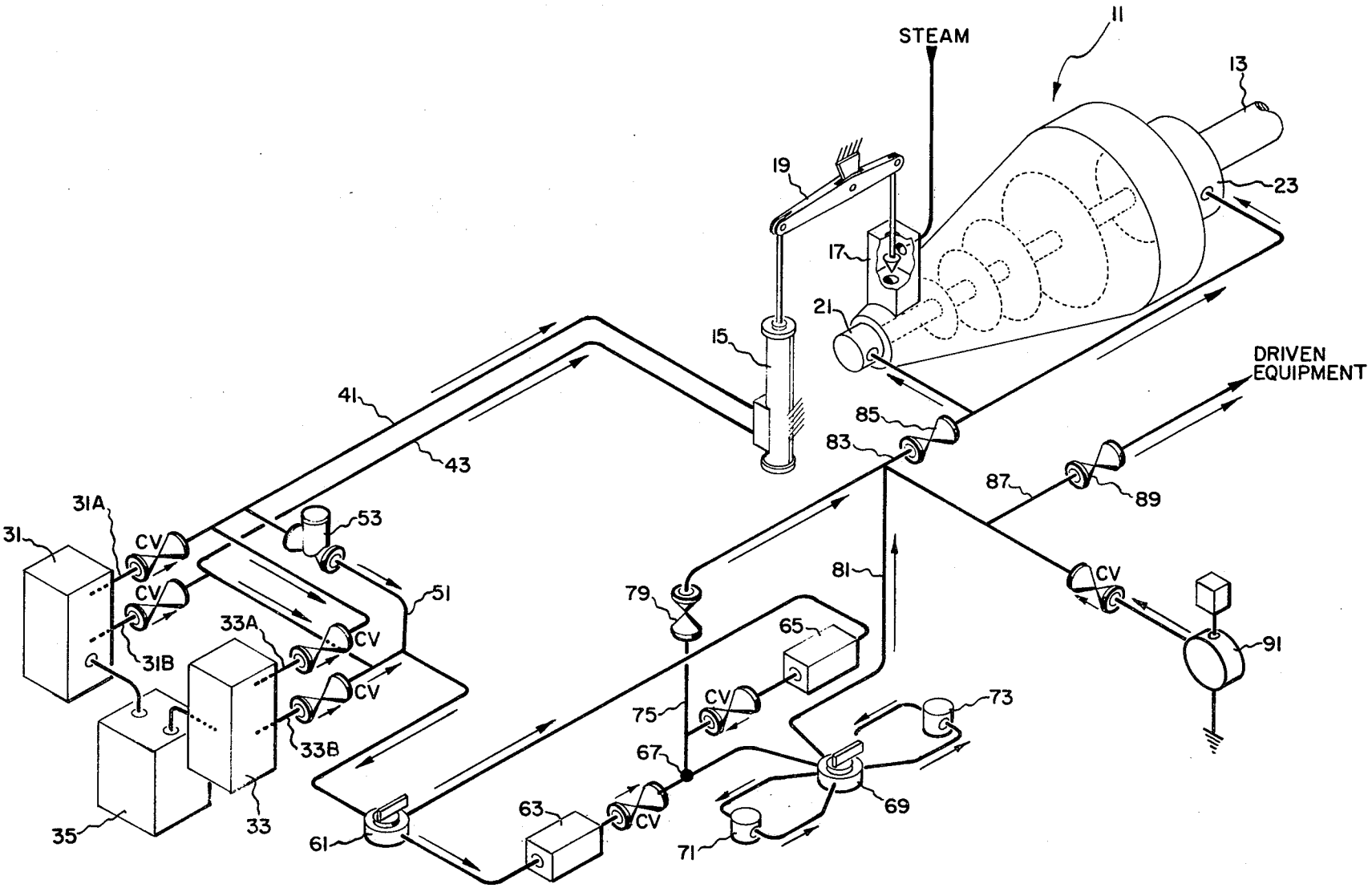
DRIVEN EQUIPMENT
STEAM
11
13
15
17
19
21
23
31
31A
31B
33
33A
33B
35
41
43
51
53
61
63
65
67
69
71
73
75
79
81
83
85
87
89
91
CV

DUAL PRESSURE LEVEL OIL SUPPLY SYSTEM

BACKGROUND OF THE INVENTION

This invention relates in general to prime movers and, in particular, this invention relates to an oil supply system for a prime mover wherein the prime mover requires both high pressure oil and low pressure oil.

One type of prime mover is a steam turbine wherein an oil supply system is required to provide hydraulic fluid for control purposes and lubrication purposes. High pressure control oil is needed for positioning steam inlet valves whereas low pressure oil is needed for lubricating tubine bearings. In addition, low pressure oil may be used for positioning pilot valves which supply fluid logic in modern steam turbine control systems.

Prior art oil supply systems include an oil pump which may be driven by the main turbine shaft through a gear coupling. The pump was designed to provide a single oil output at the highest overall required pressure which, as previously mentioned, is the control oil for steam inlet valve positioning. Lubrication and other low pressure oil requirements were satisfied by low pressure oil lines which included pressure reducing valves. This system, as described, has several disadvantages in that all the oil which is supplied is raised to the higher energy level requiring a larger pump motor and greater consumption of energy. Moreover, the oil runs hotter at a higher pressure requiring increased oil cooler duty. Another difficulty inherent in the aforedescribed system occurs during transfer from one main oil pump to a stand-by main oil pump where upon as the system is readjusting to proportionate flow, the low pressure requirement may override the high pressure requirement causing the steam inlet valve to move to a more closed position. Other systems are known wherein two pumps are utilized, one pump for high pressure and the other pump for low pressure. However, one disadvantage of this type of system is that if the low pressure system fails while the high pressure system causes the valves to remain open, damage could occur to system components which require lubrication.

The present invention seeks to overcome the foregoing difficulties and deficiencies according to the following brief summary of the invention. A centrifugal dual pressure level oil pump provides a high pressure oil discharge for the control portion of the turbine and a low pressure oil discharge for lubrication. Hence, the need for pressure reducing valves in the low pressure oil supply pipes is obviated and pump horsepower is conserved since only a portion of the total pump output is raised to the higher pressure. Moreover, a pump failure will automatically close the steam inlet valves in order to protect the turbine bearings. The centrifugal pump is a multi-stage device sized so that the low pressure discharge is taken downstream from a first stage and the high pressure discharge is taken downstream from the last stage. The pump has a lower horsepower rating and therefore is less expensive to operate. The low pressure oil runs cooler and during pump transfer to a stand-by pump, pressure differential valves prevent the loss of control oil to lubrication oil while the stand-by pump is coming up to speed. Hence the position of the steam valves does not change due to oil pressure decay.

It is therefore one object of the present invention to provide an oil supply system for a turbomachine having improved efficiency.

It is another object of the present invention to provide an oil supply system for a turbomachine which obviates losses associated with the use of pressure reducing valves.

It is a further object of the invention to provide an oil supply system for a turbomachine which may avoid sacrificing high pressure oil in order to satisfy low pressure oil during pump transfer conditions.

The foregoing is but a brief introduction into the objects, advantages and operation of the present invention. Other objects and advantages will become apparent from the following detailed description of the invention and the novel features will be particularly pointed out herein after in the claims.

BRIEF DESCRIPTION OF THE DRAWING

The drawing shows a schematic representation of a turbomachine and an oil supply system in accordance with the present invention.

DETAILED DESCRIPTION OF THE INVENTION

The drawing shows a turbomachine as, for example, a steam turbine 11 which is connected to drive a load through an output shaft 13. The turbine is operated from a control console 15 which includes a valve actuating hydraulic cylinder and fluid logic valves, not shown, but well known in the art. The hydraulic cylinder positions the steam inlet valve 17 through valve gear 19. High pressure oil is used in the hydraulic cylinder to open the steam inlet valve against a valve closing spring whereas low pressure oil is used to position the fluid logic valves within the control console. A front end turbine bearing 21 is supplied with low pressure lubrication oil and a rear turbine bearing 23 is also supplied with low pressure lubrication oil.

The present invention is directed to a system for supplying high pressure control oil, low pressure control oil and low pressure lubrication oil to the turbine and driven equipment. The system includes a centrifugal pump having a high pressure discharge and a low pressure discharge. The pump is comprised of a motor driven, multi-stage rotor wherein the discharge ports are in communication with pre-selected rotor stages to provide a high pressure and low pressure discharge, respectively. In a preferred embodiment of the invention, two pumps are provided including an in-service main oil pump 31 and a stand-by main oil pump 33 both, of which, draw oil from an oil tank 35. This redundancy is provided for maintenance and back-up capability. The in-service main oil pump has a high pressure discharge port 31A and a low pressure discharge port 31B. The stand-by pump has a high pressure discharge port 33A and a low pressure discharge port 33B. Only one pump operates at a time and hence check valves CV are provided at the discharge ports of each pump to prevent the in-service pump from pumping into the out-of-service pump.

The high pressure discharge of either pump 31 or pump 33 is directed to the control console 15 through a high pressure oil pipe 41. A portion of the low pressure oil may be used for control purposes; specifically to position low pressure fluid logic pilot valves (not shown) within the control console. The low pressure oil is delivered to the control console through a low pressure oil pipe 43. Therefore, it is clear that the pump high pressure oil discharge and the pump low pressure oil discharge are input into the turbomachine through parallel channels obviating the use of pressure reducing valves in the low pressure pipe. Moreover, a single operating pump having a dual pressure output is supplying both high pressure and low pressure oil in accordance with the present invention.

The high pressure discharge and the low pressure discharge are in fluid communication through a connector pipe 51 having a differential pressure level control valve 53 disposed therein. The valve 53 is spring biased in the valve close direction. Under normal operating conditions valve 53 will open if the pressure difference between the high pressure flow and the low pressure flow falls below a preset adjustable level thereby allowing the high pressure flow to "trim" the low pressure flow in order to maintain a constant low pressure flow. However, during a condition of transfer between the main oil pump and the stand-by main oil pump or vice-versa, the differential pressure level control valve will remain closed until the pump going into service comes up to speed. In this way the high pressure system is protected from pressure decay or loss during pump transfer operation. This mode of operation will prevent the steam inlet valve from moving in the valve close direction during pump transfer operation.

Low pressure oil is also used for bearing lubrication in the main turbine and any driven equipment. The driven equipment is not shown but may include an electrical generator or a boiler feed pump. A portion of the low pressure discharge oil from either the main oil pump or the stand-by oil pump flows through a transfer valve 61. The transfer valve 61 diverts the oil to either one of two oil coolers 63 and 65, respectively. Two oil coolers are provided for maintenance reasons and for back-up purposes. Check valves CV are provided at the discharge end of each oil cooler to prevent the in-service oil cooler from discharging into the stand-by oil cooler.

The discharge from the in-service oil cooler flows to junction 67 where under normal operating conditions, the flow will be to a transfer valve 69. Transfer valve 69 is connected to redundant oil filters 71 and 73 respectively. In the event that it becomes necessary to by-pass the oil filters, a by-pass line 75 and by-pass valve 79 are provided. Valve 79 is spring loaded in the closed direction, but will open if the pressure in line 75 exceeds a pre-set limit.

Under normal operating conditions, the transfer valve 69 is set to divert the oil flow from junction 67 to either of two oil filters 71 and 73, respectively. The discharge of the in-service oil filter is returned to the transfer valve 69 and then discharged into lube oil line 81. Lube oil line 81 branches off into a turbine lube oil line 83 through valve 85 and a driven equipment lube oil line 87 through valve 89. Valves 85 and 89 each have metering orifices and are biased in the valve close direction. Under low flow conditions as, for example, during pump transfer conditions, valves 85 and 89 will remain closed to protect the low pressure control oil system. Under normal oil flow conditions, valves 85 and 89 will open to provide lubrication oil to the turbine bearings and driven equipment.

An emergency oil pump 91 having a check valve CV at its discharge end may be used to provide bearing oil to both the turbine and driven equipment in the event of prolonged lubrication flow low pressure.

While there is described and shown what is considered to be, at present, the preferred embodiment of the invention, it is, of course understood that various other modifications may be made therein. It is intended to claim all such modifications as fall within the true spirit and scope of the present invention.

We claim:

1. A multi-pressure, hydraulic fluid supply system for a turbomachine, the turbomachine of the type having at least one high pressure fluid input and at least one low pressure fluid input; the hydraulic fluid supply system comprising:

at least one hydraulic pump having an inlet end connected to a hydraulic fluid source;

at least one high pressure discharge port from said hydraulic pump;

at least one low pressure discharge port from said hydraulic pump; and, a high pressure fluid pipe and a low pressure fluid pipe interconnecting said pump high pressure discharge port and said pump low pressure discharge port with said turbine high pressure fluid input and said turbine low pressure fluid input, respectively.

2. The system recited in claim 1 wherein the high pressure fluid input pressure is substantially the same as the high pressure discharge pressure from the pump; and, wherein the low pressure fluid input pressure is substantially the same as the low pressure discharge pressure from the pump.

3. The system recited in claim 1 wherein the pump high pressure discharge flow and the pump low pressure discharge flow are connected in parallel flow to the turbine high pressure input and low pressure input, respectively.

4. The system recited in claim 1 further comprising:

a connector pipe between said high pressure discharge and said low pressure discharge; and, a valve disposed within said connector pipe wherein the flow through the connector pipe is controlled by the pressure differential between the high pressure flow and the low pressure flow.

5. The system recited in claim 1 wherein the hydraulic pump is a centrifugal pump having a dual pressure level discharge.

6. In combination, a turbomachine of the type having at least one high pressure fluid input and at least one low pressure fluid input and a hydraulic fluid supply system for delivering high pressure fluid and low pressure fluid to said respective turbomachine fluid inputs, said fluid supply system comprising:

at least one hydraulic pump having an inlet end connected to a hydraulic fluid source;

at least one high pressure discharge port from said hydraulic pump;

at least one low pressure discharge port from said hydraulic pump;

a high pressure pipe and a low pressure pipe interconnecting said pump high pressure and low pressure discharge ports with said turbine high pressure and low pressure fluid inputs, respectively;

a connector pipe between said high pressure pipe and said low pressure pipe; and, a valve disposed within said connector pipe wherein the flow through the connector pipe is controlled by the pressure level on the downstream side of the valve.

7. In combination, a turbomachine of the type having a high pressure control oil input a low pressure control oil input and a low pressure lubrication oil input; and an oil supply system having a dual pressure level output, said oil supply system comprising:

at least one oil pump connected to an oil reservoir and having a high pressure oil discharge port and a low pressure oil discharge port;

a high pressure oil pipe interconnecting the high pressure discharge port with the high pressure oil input;

a first low pressure oil pipe interconnecting the low pressure discharge port with the low pressure control oil input;

a connector pipe interconnecting the high pressure discharge and the low pressure discharge;

a second low pressure oil pipe interconecting the low pressure discharge port with the low pressure lubrication oil input;

a first valve disposed in said connector pipe for conserving the high pressure flow during periods of too little low pressure flow; and, a second valve disposed in said second low pressure oil pipe for conserving the low pressure control oil flow during periods of too little low pressure flow.

8. The combination recited in claim 7 wherein the oil pump is a motor driven, centrifugal, dual pressure level discharge oil pump.

* * * * *